United States Patent [19]

Nero

[11] Patent Number: 4,967,121

[45] Date of Patent: Oct. 30, 1990

[54] ISOLATING HIGH VOLTAGE TRANSFORMER FOR VIDEO APPARATUS

[75] Inventor: Leroy W. Nero, Indianapolis, Ind.

[73] Assignee: RCA Licensing Corporation, Princeton, N.J.

[21] Appl. No.: 229,776

[22] Filed: Aug. 4, 1988

Related U.S. Application Data

[63] Continuation-in-part of Ser. No. 54,906, May 27, 1987, abandoned.

[51] Int. Cl.[5] ..... H01J 29/70; G09G 1/04; H01F 27/24

[52] U.S. Cl. ..... 315/411; 315/399; 336/211

[58] Field of Search ..... 315/411, 399, 405; 336/195, 196, 211, 209; 363/59, 60, 61

[56] References Cited

U.S. PATENT DOCUMENTS

| | | | |
|---|---|---|---|
| Re. 31,119 | 1/1983 | Mitani et al. | 315/411 |
| 3,213,397 | 10/1965 | Brouerman | 336/208 |
| 3,652,968 | 3/1972 | Johnston et al. | 336/170 |
| 3,813,574 | 5/1974 | Sato | 315/29 |
| 3,946,350 | 3/1976 | Goto | 336/209 |
| 4,145,639 | 3/1979 | Willis | 315/411 |
| 4,204,263 | 5/1980 | Onoue | 363/68 |
| 4,266,269 | 5/1981 | Toba | 315/411 |
| 4,639,706 | 1/1987 | Shimizu | 336/192 X |
| 4,654,775 | 3/1987 | Nero | 363/68 |

FOREIGN PATENT DOCUMENTS

| | | | |
|---|---|---|---|
| 97599 | 1/1984 | European Pat. Off. | 336/198 |
| 2311612 | 9/1973 | Fed. Rep. of Germany | 336/208 |
| 29255 | 3/1980 | Japan | 336/96 |
| 54608 | 3/1986 | Japan | 336/198 |
| 1250827 | 10/1971 | United Kingdom | 336/198 |

OTHER PUBLICATIONS

A commercial translation for Japanese Patent Application No. SHO 61-54608, dated 3/18/86.

*Primary Examiner*—Gregory C. Issing
*Attorney, Agent, or Firm*—Joseph S. Tripoli; Joseph J. Laks; Sammy S. Henig

[57] ABSTRACT

A high voltage transformer for a video apparatus provides electrical isolation between the primary and secondary windings. The primary winding is wound on a first bobbin while the secondary windings are wound on a second separate bobbin that surrounds the first bobbin with the bobbin structure providing a physical isolation barrier. The high voltage winding is wound on a high voltage bobbin which fits over the primary and secondary bobbin structure.

8 Claims, 5 Drawing Sheets

ISOLATING HIGH VOLTAGE TRANSFORMER FOR VIDEO APPARATUS

This is a CIP of application Ser. No. 07/54,906, filed 5/27/87, now abandoned.

This invention relates to transformers for video apparatus and, in particular, to high voltage transformers providing electrical isolation between the primary and high voltage windings.

A video apparatus, such as a television receiver or a computer monitor, may incorporate user accessible terminals or jacks to facilitate input or output of video or audio signals. These user accessible terminals or jacks must be electrically isolated from the AC line supply in order to protect the user from shock hazard. Electrical isolation may be provided by isolation transformers associated with the input and output circuits themselves, but this technique may increase the cost and complexity of video apparatus having many input or output terminals. Electrical isolation may also be provided in the power supply circuitry, such as via a chopper transformer in a switched mode power supply, for example.

In a video apparatus having a power supply utilizing an SCR regulator, electrical isolation may be provided via the high voltage transformer. The high voltage transformer typically incorporates a primary winding to which a regulated B+ voltage is applied. One or more secondary or load circuit windings are provided. Voltages developed across the secondary windings are used to power various load circuits of the video apparatus. A high voltage winding develops a high voltage or ultor potential for the cathode ray tube of the video apparatus. The voltage levels present within the transformer require that care be taken in the design and manufacture of the high voltage transformer in order to reliably maintain the electrical isolation barrier during the lifetime of the video apparatus.

In accordance with an aspect of the present invention, a high voltage transformer providing electrical isolation for use in a video apparatus comprises a magnetically permeable core. A first bobbin encircles the core and has a first winding for being energized from a first voltage. A second bobbin surrounds the first bobbin and has a second winding coupled to a load circuit that is electrically isolated from the first voltage. A third bobbin surrounds the second bobbin and has a high voltage winding, electrically isolated from the first voltage, for generating an ultor potential in response to the energization of the first winding.

In the accompanying drawing.

Figure 1:
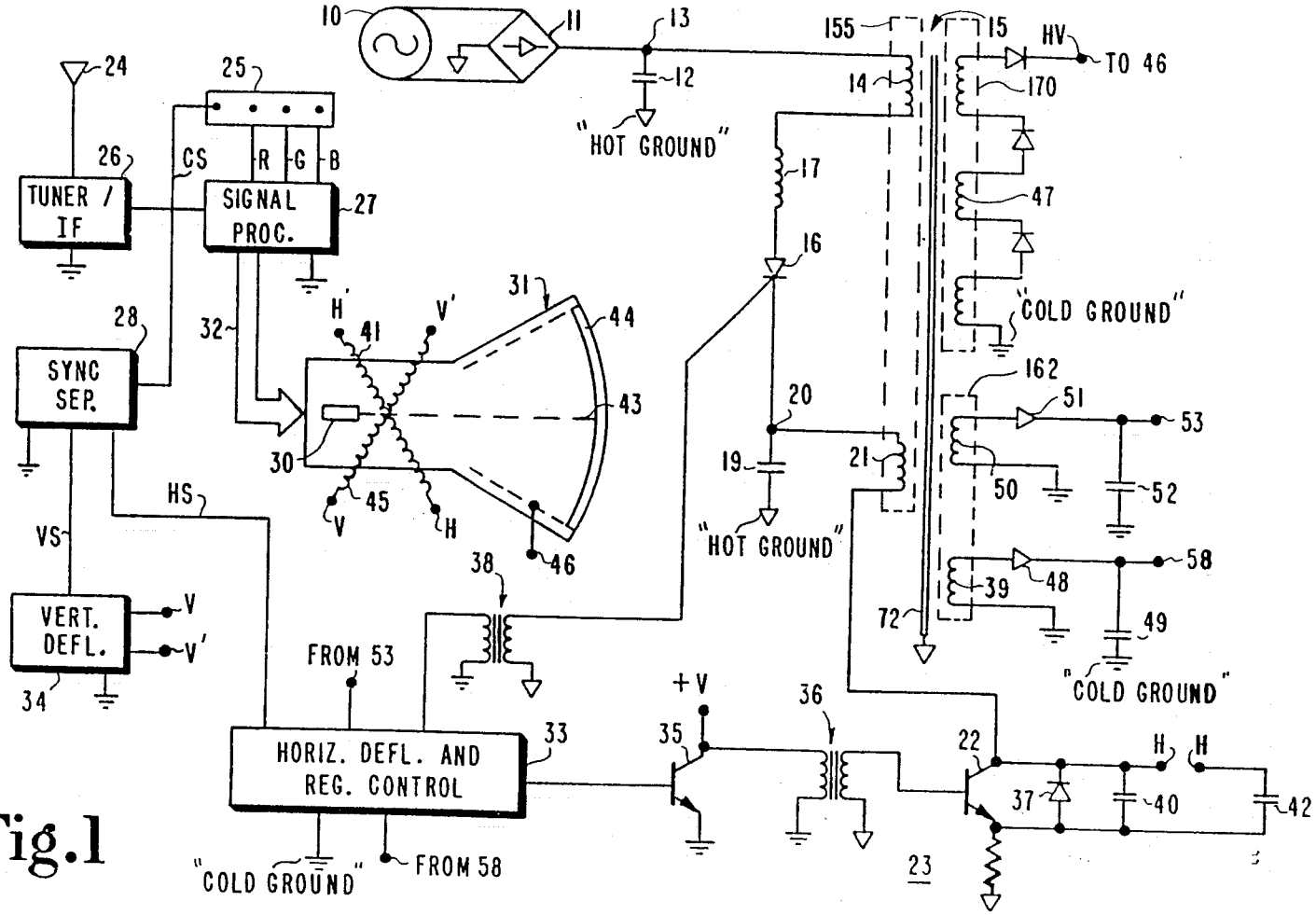
FIG. 1 is a block and schematic diagram of a portion of a video apparatus in accordance with an aspect of the present invention.

Referring to FIG. 1, a power source 10, such as an AC line supply, is coupled to a rectifying circuit 11, the output of which is filtered by a capacitor 12 to provide a source of unregulated DC voltage at a terminal 13. The unregulated DC voltage is applied to one terminal of a winding 14 of a novel high voltage transformer 15, the detailed construction of which will be explained later. The other terminal of winding 14 is coupled to the anode of an SCR 16 via an inductor 17. The conduction of SCR 16 is controlled in a manner that will be described later to produce a regulated DC voltage across capacitor 19 at a terminal 20, located at the cathode of SCR 16. The regulated DC voltage is applied via a primary winding 21 of transformer 15 to the collector of a horizontal deflection output transistor 22, which forms part of a horizontal deflection output circuit 23.

The video apparatus shown in FIG. 1, such as a television receiver or computer monitor, for example, illustratively receives an input signal from an antenna 24, in the case of a television receiver, or via an input terminal block 25 from an external source of signals, in the case of a computer monitor. The radio frequency signal from antenna 24 is applied to tuner and intermediate frequency (IF) circuitry 26, the output of which is applied to signal processing circuitry 27 and to synchronizing (sync) pulse separator circuit 28. Signal processing circuitry 27 may, for example, include the functions of video detection, chrominance processing and luminance processing. Signal processing circuitry provides the drive signals to the electron gun assembly 30 of a cathode ray tube 31 via a conductor 32. Sync separator 28 provides the individual horizontal, or line rate, and vertical, or field rate, pulses from the composite video signal output of signal processing circuitry 27. The signal from terminal block 25 illustratively provides direct red, green and blue video signals designated R, G and B to signal processing circuitry 27, as well as a composite synchronizing signal, designated CS, to sync separator circuit 28.

The vertical, or field-rate, synchronizing signal is appied via a conductor designated VS to a vertical deflection circuit 34, which produces vertical deflection current via terminals V and V′ in a vertical deflection winding 45, located on the neck of CRT 31. Deflection current flow in winding 45 causes the deflection or scanning of a representative electron beam 43, produced by electron gun assembly 30, at a field rate across the phosphor display screen 44 of CRT 31.

The horizontal, or line-rate, synchronizing signal is applied via a conductor designated HS, to horizontal deflection and regulator control circuitry 33, which provides a horizontal rate switching signal to a driver transistor 35. Switching of transistor 35 in turn causes switching pulses to be applied to the base of horizontal output transistor 22 via driver transformer 36. Horizontal deflection output circuit 23 illustratively comprises a conventional resonant retrace circuit including a damper diode 37, a retrace capacitor 40, a horizontal deflection winding 41, located on the neck of CRT 31, and an S-shaping capacitor 42. The operation of horizontal deflection output circuit 23 causes deflection current to flow in deflection winding 41 via terminals H and H′, thereby generating electromagnetic deflection fields that deflect or scan electron beam 43 at a line rate on the phosphor display screen 44 of CRT 31.

Horizontal deflection and regulator circuit 33 also produces horizontal deflection rate gating pulses to the gate terminal of SCR 16 via transformer 38 in order to switch SCR 16 into conduction. The time of occurrence of a gating pulse within each horizontal deflection interval is controlled in accordance with a feedback signal in order to maintain a constant regulated voltage level at terminal 20. SCR 16 is commutated off in a conventional manner by retrace related pulses appearing across winding 14. The horizontal retrace pulses appearing across primary winding 21, produced by horizontal output circuit 23 in response to the switching of horizontal output transistor 22, cause voltage pulses to be developed across the other windings of transformer 15, including the previously described SCR - commutating pulses produced across winding 14. The voltage developed across high voltage winding 47 is rectified to provide, at a terminal designated HV, a high voltage or ultor potential of the order of 28 KV, that is applied to ultor terminal 46 of CRT 31 in order to provide the accelerating potential for electron beam 43. The voltage developed across secondary winding 50 is rectified by diode 51 and filtered by capacitor 52 to provide a regulated DC voltage source at a terminal 53 that may illustratively be used to power various load circuits of the video apparatus, for example, horizontal deflection and regulator control circuit 33. The voltage developed across winding 39 is rectified by diode 48 and filtered by capacitor 49 to illustratively provide the feedback signal to horizontal deflection and regulator control circuitry 33 via a terminal 58.

The input terminals and/or jacks of terminal block 25 represent user accessible terminals that must be electrically isolated from the AC line supply 10 in order to reduce user shock hazard. In accordance with an aspect of the present invention, high voltage transformer 15 provides electrical isolation, which limits the maximum current that can flow between two isolated circuit points, between the AC line supply 10 and the user accessible terminals, including terminal block 25, for example, of the video apparatus.

Figure 2:
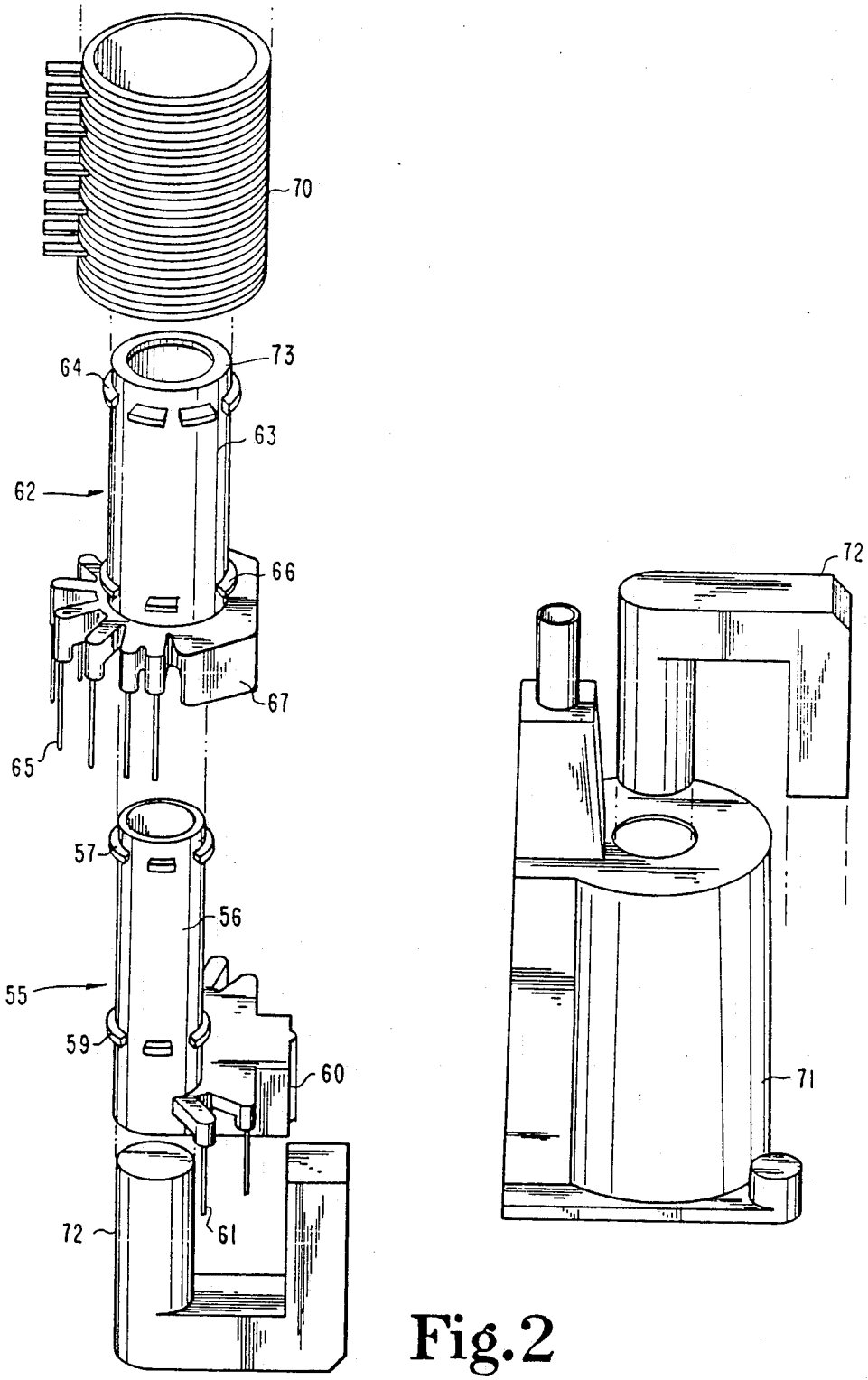
FIG. 2 is an exploded isometric view of a portion of a high voltage transformer in accordance with an aspect of the present invention.
Figure 3:
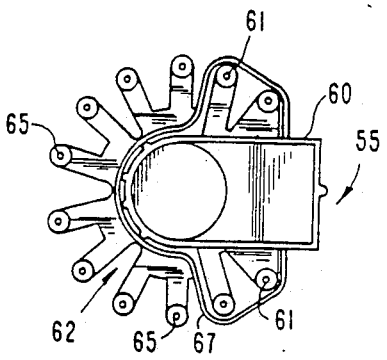
FIG. 3 is a bottom plan view of a part of the transformer shown in FIG. 2.
Figure 4:
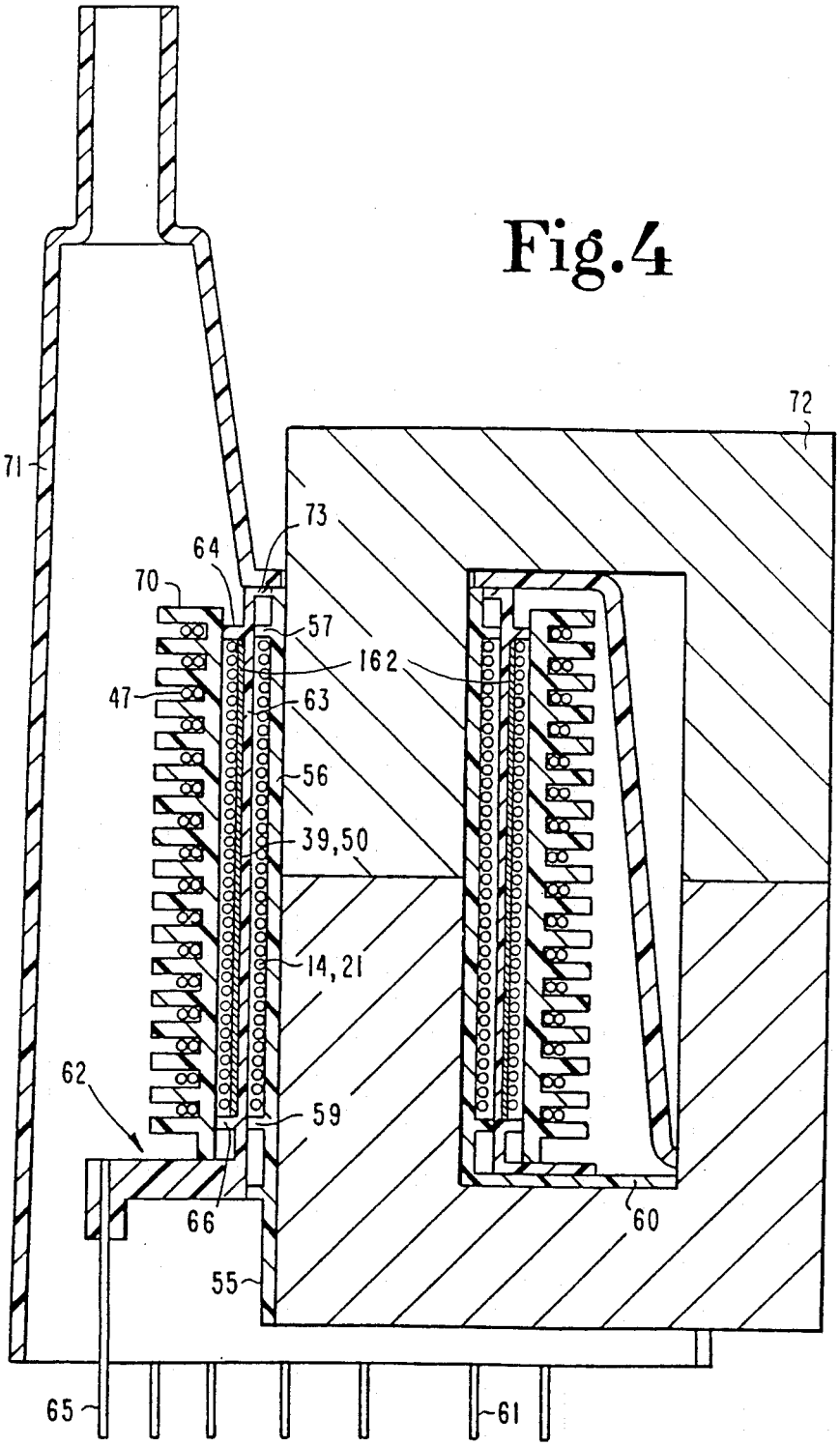
FIG. 4 is a side elevational cross sectional view of a transformer similar to that shown in FIG. 2.

Referring to FIGS. 2, 3, 4 and 5, the construction detail of transformer 15, illustrating the novel aspects of the present invention, will now be described. Similar symbols and numerals in FIGS. 1–5 indicate similar items or functions. Transformer 15 comprises a first bobbin 55, upon which are illustratively wound winding 14 and primary winding 21. Windings 14 and 21 are electrically nonisolated from the AC line supply 10, and are referenced to a point of reference potential referred to in FIG. 1 as "hot ground" and designated with a particular ground symbol. Dashed lines 155 in FIG. 1 schematically represent bobbin 55. Bobbin 55 comprises a cylindrical portion 56 about which the windings are wound. As shown in FIG. 4, the windings wound on bobbin 55 illustratively traverse substantially the entire winding region defined by winding stops 57 and 59. Bobbin 55 also includes a radially extending foot or base portion 60, about which are distributed terminal pins 61. Ones of terminal pins 61 are selectively connected to the windings wound on bobbin 55 for making contact with the appropriate video apparatus circuit elements via a printed circuit board (not shown).

Figure 5:
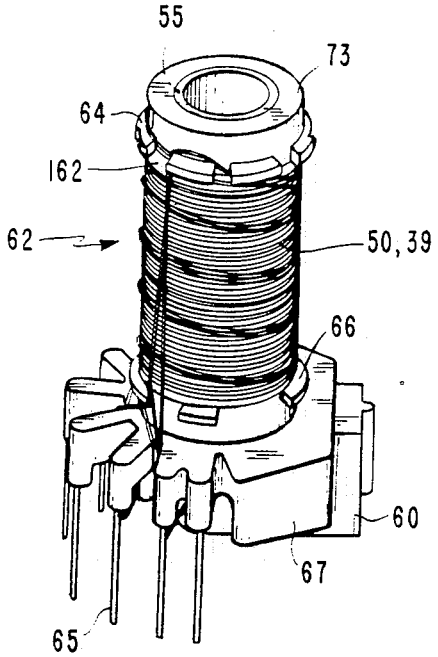
FIG. 5 is an isometric view of nested first and second bobbins and of a secondary winding wound on the second bobbin of the high voltage transformer shown in FIG. 2.

A second bobbin 62 is dimensioned to fit around bobbin 55 such that bobbin 55 nests within bobbin 62. Bobbin 62 also comprises a cylindrical portion 63. In accordance with a feature of the invention, an electrically adhesive tape 162 encircles cylindrical portion 63 of bobbin 62. Adhesive tape 162 surrounds substantially the full traverse and circumference of the winding region of bobbin 62 defined by winding stops 64 and 65. Adhesive tape 162 forms a cylindrical layer about which the secondary winding, illustratively including winding 39 and 50, for example, are wound as shown in FIG. 5. Winding 39 and 50 are illustratively wound to cover substantially the full tranverse of the winding region defined by winding stops 64 and 65. Winding 39 and 50 of FIG. 1, and the associated video apparatus load circuits connected thereto or powered therefrom, are electrically isolated from windings 14 and 21, and consequently are isolated from the AC line supply 10. Windings 39 and 50, and associated load circuitry, are referenced to a point of reference potential referred to in FIG. 1 as "cold ground" and designated by a particular ground symbol. Dashed lines 162 in FIG. 1 schematically illustrate bobbin 62. Terminal pins 65 are distributed about the perimeter of the base of the cylindrical portion 63 of bobbin 62 in order to provide electrical contact via a printed circuit board between windings 39 and 50 and various circuit components of the video apparatus. Bobbin 62 also incorporates a base portion which defines an area by way of wall structure 67. When bobbin 55 becomes nested within bobbin 62 during assembly of transformer 15, the area defined by wall structure 67 acts to enclose terminal pins 61 of bobbin 55, as can be seen in FIG. 3, thereby providing a physical separation barrier between the electrically isolated terminal pins 61 and 65. The use of the two bobbins 55 and 62 and of adhesive tape 162 results in the physical presence of the cylindrical portion 63 of bobbin 62 being located between the "cold" windings 39 and 59 and the "hot" windings 14 and 21, thereby providing an effective and reliable electrical isolation barrier.

A high voltage bobbin 70, about which is wound high voltage or tertiary winding 47, surrounds bobbin 62. Dashed lines 170 in FIG. 1 represent high voltage bobbin 70. High voltage winding 47 is also referenced to the "cold" ground reference potential. The "cold" low voltage windings 39 and 50 are therefore physically located between the "cold" high voltage winding 47 and the "hot" windings 14 and 21, thereby providing a high voltage discharge path to "cold ground" in the event arcing of the high voltage winding should occur. The bobbin structure formed by bobbins 55, 62 and the high voltage bobbin 70, are located within a transformer housing 71. Housing structure 71 may be filled with epoxy in a conventional manner in order to encapsulate or pot the wound bobbin structure. A magnetically permeable core 72 is inserted within the interior of cylindrical portion 56 of bobbin 55 to provide proper inductance for the tuning of transformer 55 in a conventional resonant retrace circuit of the video apparatus.

A fault condition ocurring in, for example, high voltage winding 47 of transformer 15, may cause a sudden deformation or breaking of the physical winding structure in transformer 15. It may be desirable to prevent any such breaking of the physical winding structure from causing a short circuit between the conductors of the winding turns that are referenced to the "cold ground" and those that are referenced to the "hot ground"and those that are referenced to the "hot ground". Should such short circuit occur, AC line supply 10 might become conductively coupled to the "cold ground". Consequently, a user, making contact with a conductor that is coupled to the "cold ground", may be subjected to an electrical shock hazard. Accordingly, in accordance with another feature of the invention, bobbin 62, adhesive tape 162 and the aforementioned epoxy encapsulation deter the possibility of such short circuit by providing corresponding separate physical, as well as, electrical isolation barriers between the windings that are referenced to the "cold ground" and those referenced to the "hot ground". Each such separate barrier tends to reduce the possibility of the aforementioned short circuit from occuring. Consequently, the isolation effect of each such barrier is supplemented by that of the others.

FIG. 4 illustrates a cross sectional view of assembled transformer 15, showing the positioning of the structural elements shown in FIG. 2. The winding stops 57 and 59 on bobbin 55 and winding stops 64 and 65 on bobbin 62 also act to stabilize the relative positioning of bobbins 55, 62 and 70 of the assembled bobbin structure. Bobbin 62 also includes, in accordance with an additional feature of the invention, an inwardly extending lip 73 that forms a circular rim and that provides an additional physical barrier, thereby increasing the length of a possible arc path between windings 14 and 21, and windings 39 and 50. By encircling the top portion of bobbin 62, lip 73 is interposed in a possible path of an arc, should such arc occur between the winding turns of windings 14 and 21 and between the winding turns of windings 39 and 50 or between those of winding 70. In particular, lip 73 isolates winding turns, not shown, that are wound over winding stop 57 of FIG. 2 from those wound over winding stop 64 of FIG. 5, and also from those at the top portion of winding 70 of FIG. 4. In this way, the aforementioned electrical shock hazard is substantially reduced. As can be seen in FIG. 1, core may also be referenced to "hot ground" with the result that core 72 and the windings on inner bobbin 55 are referenced to "hot ground", while the windings on outer bobbin 62 and high voltage winding 47 are referenced to "cold ground", thereby necessitating only a single electrical isolation barrier in transformer 15.

I claim:

1. A power supply apparatus of a video apparatus, comprising:

a source of a mains supply voltage;

switching means responsive to an input signal at a given frequency and coupled to said source for generating a first voltage that is conductively coupled in an electrically nonisolated manner to said mains supply voltage at a frequency that is related to that of said input signal; and a high voltage transformer, including:

a magnetically permeable core;

a first bobbin encircling said core and having a first winding wound on said bobbin, said first winding being conductively coupled in an electrically nonisolated manner to said first voltage for energizing said transformer;

a second bobbin encircling said first winding and having a second winding wound on said second bobbin for transformer coupling said first voltage via said first winding to said second winding to develop a second voltage in said second winding that is conductively isolated from said mains supply voltage and that is coupled to a first load circuit of said video apparatus, said second bobbin providing an isolation barrier between said first and second windings; and a third bobbin encircling said second winding and having a high voltage winding wound on said third bobbin for transformer coupling said first voltage to said high voltage winding to develop a high amplitude high voltage in said high voltage winding that is coupled to a high voltage electrode of a cathode ray tube of said video apparatus and that is conductively isolated from said mains supply voltage, such that said second and third bobbins provide an isolation barrier between said high voltage and first windings.

2. The arrangement defined in claim 1 wherein said magnetically permeable core is electrically nonisolated from said mains supply voltage.

3. The arrangement defined in claim 1, wherein said first bobbin and said second bobbin further comprise terminal pins and at least one of said first and second bobbins comprises a wall structure for providing separation between the respective terminal pins of said first and second bobbins.

4. The arrangement defined in claim 1, wherein said second bobbin incorporates an inwardly extending lip structure for increasing the electrical arc path length between said first winding and said second winding.

5. The arrangement defined in claim 1, wherein said first winding is coupled to and provides power to a line-rate deflection output circuit of said video apparatus.

6. An apparatus according to claim 1 wherein said second winding provides a discharge path through said second winding should arcing of said high voltage winding occur, said discharge path being electrically isolated from said mains supply voltage by said second and third bobbins.

7. An apparatus according to claim 1, wherein every winding that is wound on said second bobbin is a low voltage winding.

8. A power supply apparatus of a video apparatus, comprising:

a source of a mains supply voltage;

switching means responsive to an input signal at a given frequency and coupled to said source for generating a first voltage that is conductively coupled in an electrically nonisolated manner to said mains supply voltage at a frequency that is related to that of said input signal; and a high voltage transformer, including:

a magnetically permeable core;

a first bobbin encircling said core and having a first winding wound on said bobbin, said first winding being conductively coupled in an electrically nonisolated manner to said first voltage for energizing said transformer:

a second bobbin encircling said first winding and having a second winding wound on said second bobbin for transformer coupling said first voltage via said first winding to said second winding to develop a second voltage in said second winding that is conductively isolated from said mains supply voltage and that is coupled to a first load circuit of said video apparatus, said second bobbin providing an isolation barrier between said first and second winding;

a third bobbin encircling said second winding and having a high voltage winding wound on said third bobbin for transformer coupling said first voltage to said high voltage winding to develop a high amplitude high voltage in said high voltage winding that is coupled to a high voltage electrode of a cathode ray tube of said video apparatus and that is conductively isolated from said mains supply voltage, such that said second and third bobbins provide an isolation barrier between said high voltage and first windings; and an electrically isolating tape that is disposed around said second bobbin between said second bobbin and said second winding for providing a further isolation barrier between said first and second windings.

* * * * *